US008042228B2

(12) United States Patent
Jones

(10) Patent No.: US 8,042,228 B2
(45) Date of Patent: Oct. 25, 2011

(54) ADJUSTABLE HINGE MOUNTING BLOCK

(75) Inventor: Terry D. Jones, North Syracuse, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 511 days.

(21) Appl. No.: 12/244,070

(22) Filed: Oct. 2, 2008

(65) Prior Publication Data

US 2010/0083465 A1 Apr. 8, 2010

(51) Int. Cl.
*E05D 7/00* (2006.01)

(52) U.S. Cl. ..... 16/221; 16/247; 16/248; 16/249; 16/362; 16/387; 16/391

(58) Field of Classification Search ..... 16/221, 16/233, 246–249, 362, 364, 382, 387, 388, 16/390–391; 29/11
See application file for complete search history.

(56) References Cited

U.S. PATENT DOCUMENTS

| | | | | | |
|---|---|---|---|---|---|
| 566,323 | A | * | 8/1896 | Kelleher et al. | 16/249 |
| 1,537,869 | A | * | 5/1925 | Murray | 49/168 |
| 2,154,716 | A | * | 4/1939 | Anderson | 16/247 |
| 3,229,323 | A | * | 1/1966 | Hensgen | 16/247 |
| 3,263,368 | A | * | 8/1966 | Hildum et al. | 49/382 |
| 4,193,820 | A | * | 3/1980 | Thomas | 136/244 |
| 4,554,706 | A | * | 11/1985 | Rock et al. | 16/237 |
| 4,703,539 | A | * | 11/1987 | Lautenschlager et al. | 16/240 |
| 4,712,271 | A | | 12/1987 | Sundermeier | |
| 4,862,556 | A | | 9/1989 | Grass | |
| 5,056,190 | A | * | 10/1991 | Rock et al. | 16/240 |
| 5,144,721 | A | | 9/1992 | Schade | |
| 5,295,282 | A | * | 3/1994 | Lautenschlager | 16/237 |
| 5,621,947 | A | * | 4/1997 | Fitz et al. | 16/249 |
| 5,964,010 | A | * | 10/1999 | Huber | 16/237 |
| 6,158,086 | A | * | 12/2000 | De Souza | 16/247 |
| 6,971,142 | B2 | * | 12/2005 | Lautenschlager | 16/382 |
| 2002/0078528 | A1 | * | 6/2002 | Gledhill | 16/362 |
| 2006/0137140 | A1 | * | 6/2006 | Christeson et al. | 16/247 |
| 2006/0260096 | A1 | * | 11/2006 | Fries | 16/246 |

OTHER PUBLICATIONS

International Search Report dated Dec. 30, 2009 for related application PCT/US2009/059350.

* cited by examiner

*Primary Examiner* — Victor Batson
*Assistant Examiner* — Roberta Delisle
(74) *Attorney, Agent, or Firm* — Howard IP Law Group, PC

(57) ABSTRACT

An adjustable hinge block includes first and second complementary members, each defining therein a first and a second slit respectively. The members are adapted to mate with each other such that the first and second slits at least partially align with each other to define a third slit. First and second wing members protrude from the members respectively such that the wing members lie on opposite sides of the third slit when the members mate with each other. The wing members each define therein a first and a second aperture respectively, which first and second apertures are adapted to receive a fastener. First and second side members, each define therein a third and a fourth aperture respectively, such that the third and fourth apertures is adapted to align with the first and second apertures respectively.

11 Claims, 7 Drawing Sheets

ADJUSTABLE HINGE MOUNTING BLOCK

STATEMENT REGARDING FEDERALLY SPONSORED RESEARCH OR DEVELOPMENT

This invention was made with United States Government support under Contract Number N68786-06-C-6205 awarded by the United States Navy and the United States Government may have certain rights in the invention.

FIELD OF THE INVENTION

The invention relates generally to hinge mounting blocks and particularly to adjustable hinge mounting blocks.

BACKGROUND OF THE INVENTION

In some cases, such as in a submarine, structural posts are welded between the floors and ceilings. The areas between the posts are called "bays" and may be used to install electronic and other equipment. Doors may be mounted between the structural posts to protect the equipment and sometimes to create an air tight seal. These bays may be cooled by heat exchangers and thus, it is important to keep bays cool and not allow cool air to escape out of the bays.

A hinge block, such as one illustrated in FIG. 1, has been used to mount two doors on a single structural post. This method works well only if all the structural posts are "true" or orthogonal with respect to the floors and ceilings and simultaneously parallel to each other. If there is even a slight misalignment between two posts, installation of two doors on two bays, between three structural posts becomes difficult and laborious. Adjusting each door then requires extra labor and force which may result in damage to the hardware as well as to the doors themselves, which may become warped. Alternatives are desired.

SUMMARY OF THE INVENTION

According to an aspect of the present invention, an adjustable hinge block includes first and second complementary members each defining therein a first and a second slit respectively. The first and second members are adapted to mate with each other such that the first and second slits at least partially align with each other to define a third slit. The hinge block further includes first and second wing members protruding from the first and second members respectively such that the first and second wing members lie on opposite sides of the third slit when the first and second members mate with each other. Each of the first and second wing members defines therein a first aperture and a second aperture respectively. The adjustable hinge block also includes first and second side members, each defining therein a third and a fourth aperture respectively, such that the third and fourth apertures are adapted to align with the first and second apertures of the first and second wing members respectively.

According to an aspect of the invention, a method of installing two doors on a structural member includes a step of mounting an adjustable hinge block on the structural member. The adjustable hinge block includes first and second members, each defining therein first and second slits respectively. The first and second members are adapted to mate with each other such that the first and second slits at least partially align with each other to define a third slit. The adjustable hinge block further includes first and second wing members protruding from the first and second members respectively such that the wing members lie on opposite sides of the third slit when the first and second members mate with each other. Each of the first and second wing members defines therein a first and a second aperture respectively. The method then includes a step of connecting the first and second complementary members to the structural member using a fastener, which fastener passes through the third slit. The method includes the step of connecting the first and second side members to the first and second members using a fastener. The first and second side members are adapted to provide symmetrical and asymmetrical connections with respect to the first and second complementary members. The method further includes the step of connecting a door to each of the first and second side members using a fastener.

BRIEF DESCRIPTION OF THE DRAWINGS

Understanding of the present invention will be facilitated by consideration of the following detailed description of the exemplary embodiments of the present invention taken in conjunction with the accompanying drawings, in which like numerals refer to like parts and in which.

DETAILED DESCRIPTION OF PREFERRED EMBODIMENTS

The invention and its various embodiments can now be better understood by turning to the following detailed description of the exemplary embodiments which are presented as illustrated examples of the invention defined in the claims. It is expressly understood that the invention as defined by the claims may be broader than the illustrated embodiments described below. It is to be understood that the figures and descriptions of the present invention have been simplified to illustrate elements that are relevant for a clear understanding of the present invention, while eliminating, for purposes of clarity, many other elements found in typical hinge mounting blocks. However, because such elements are well known in the art, and because they do not facilitate a better understanding of the present invention, a discussion of such elements is not provided herein. The disclosure herein is directed to all such variations and modifications known to those skilled in the art.

Figure 1:
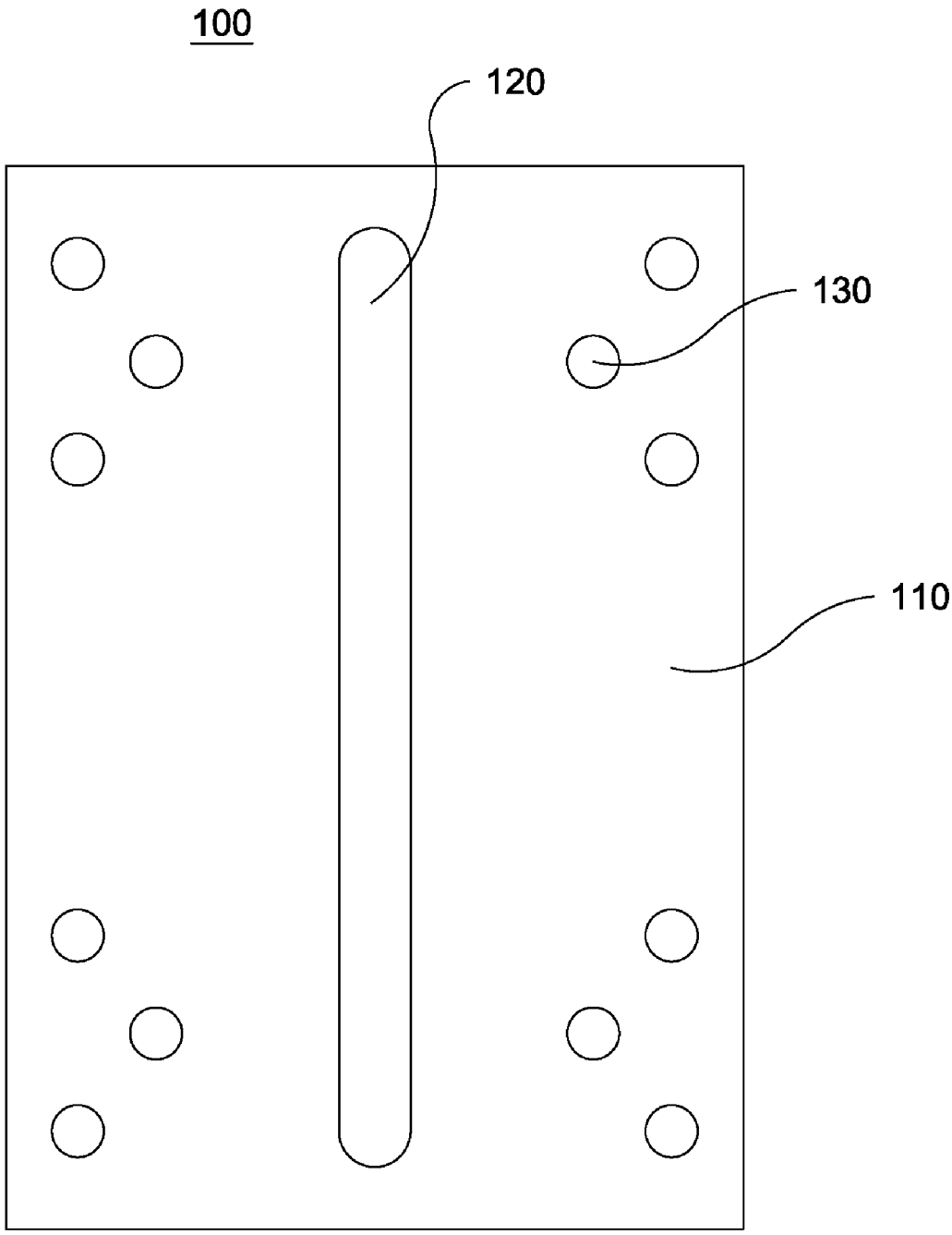
Fig. 1 (Prior Art)
FIG. 1 is a prior art hinge block used to install two doors on a single structural post.

Referring initially to FIG. 1, a front view of a prior art hinge block 100 is illustrated. Hinge block 100 includes a machined block 110, generally made of metal. A longitudinal slit 120 is formed generally in the central part of block 110. A series of apertures 130 are made in each corner of block 110. Apertures 130 are adapted to receive fasteners. Hinge pins (not shown) and door closure hardware (not shown) are mounted to hinge block 100 using fasteners (not shown).

Figure 2:
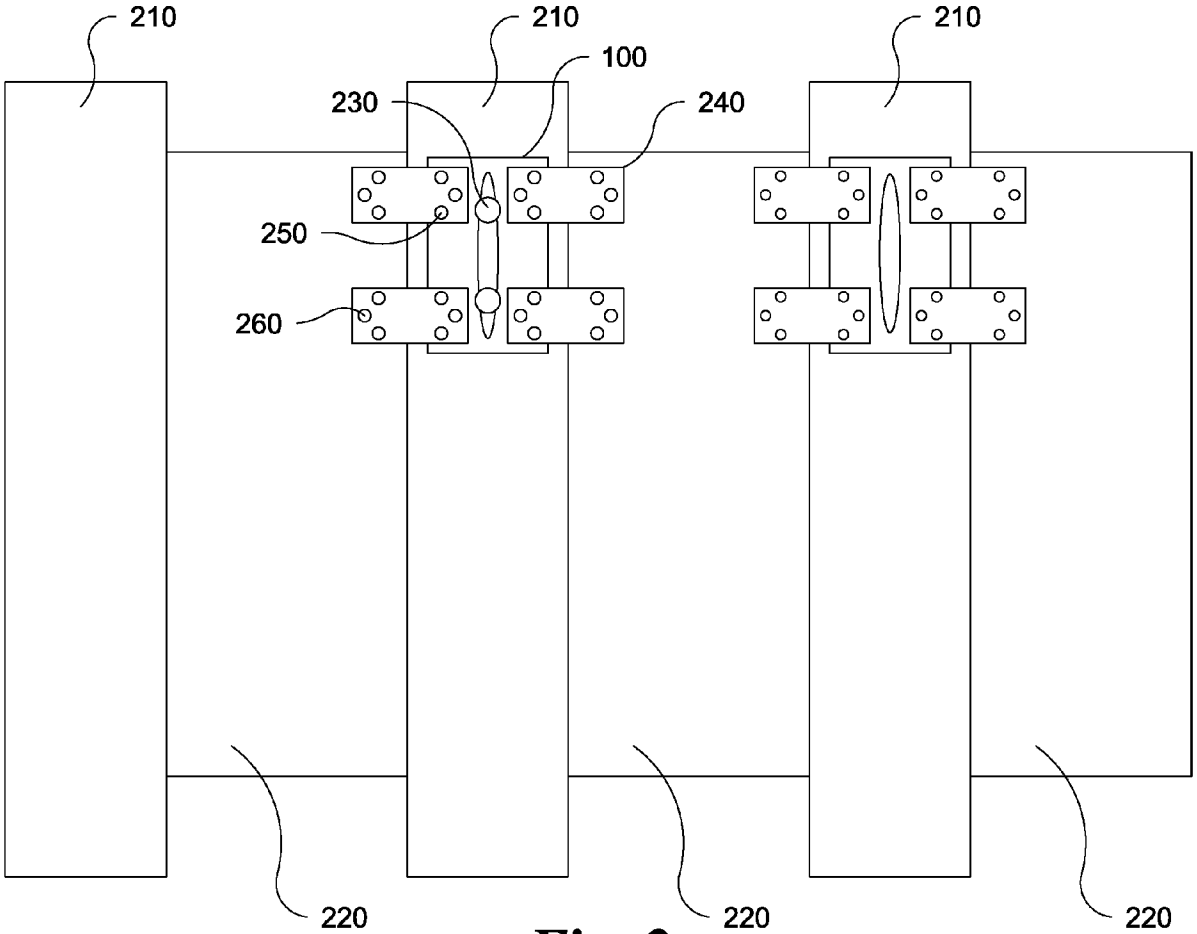
Fig. 2 (Prior Art)
FIG. 2 is a prior art method of installing two doors to a single structural post using the prior art hinge block of FIG. 1.

Referring now to FIG. 2, a prior art method of mounting two doors 220 on a single structural post 210 using hinge block 100 is described. Occasionally, each door 220 will be connected to both the structural posts 210 on either side of door 220. It will be appreciated by one of ordinary skill in the art that a slight misalignment between first post 210 and first door 220 will make the alignment of first door 220 and second post 210 difficult and such misalignment will propagate and even amplify as subsequent doors 220 are sequentially connected to subsequent posts 210.

Figure 3:
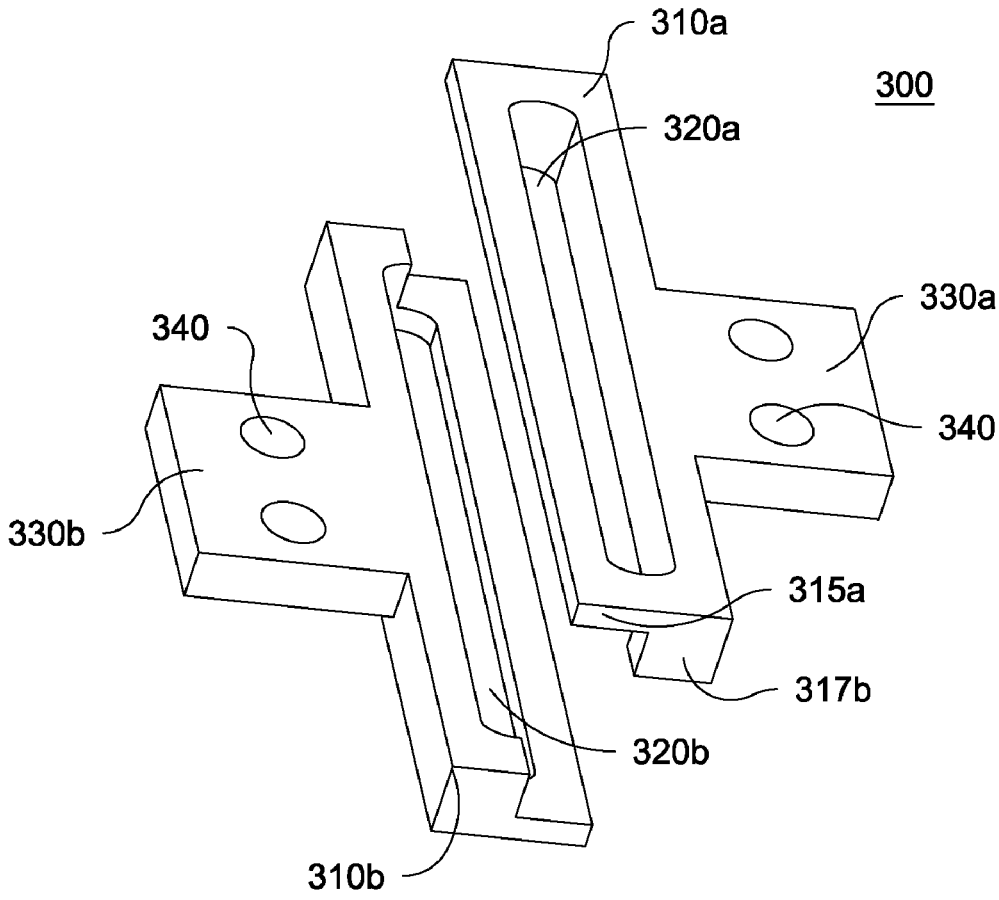
FIG. 3 is an isometric view of a pair of complementary hinge block members as per an embodiment of the invention.

Referring now to FIG. 3, a pair 300 of complementary hinge block members 310*a*, 310*b* is illustrated. Each member 310*a*, 310*b* has a generally planar structure 315*a*, 315*b* and a projection 317*a*, 317*b* generally perpendicular to structure 315*a*, 315*b*, respectively. In an exemplary embodiment, structure 315*a*, 315*b* is generally rectangular in shape. Other shapes are also possible. Each planar structure 315*a*, 315*b* has a longitudinal slit 320*a*, 320*b* respectively defined therein. The term "longitudinal" denotes a shape that has a high length to width ratio. In an exemplary embodiment, slits 320*a*, 320*b* has beveled edges. Projections 317*a*, 317*b* have generally half the width of structures 315*a*, 315*b*. Each member 310*a*, 310*b* has a wing member 330*a*, 330*b* projecting generally orthogonally from structures 315*a*, 315*b*, respectively. In the illustrated embodiment, wing members 330*a*, 330*b* are generally square in shape; however, other shapes are also possible. Each wing member 330*a*, 330*b* has through apertures 340 defined therein. In the illustrated embodiment, each wing member 330*a*, 330*b* has two (2) apertures 340 each. In other embodiments, wing members 330*a*, 330*b* may have more or less than two (2) apertures. Apertures 340 are adapted to receive fasteners such as screws and bolts. Apertures 340 may or may not have internal threads (not shown) for engaging with fasteners (not shown). Members 310*a*, 310*b* are adapted to mate with each other such that structure 315*a* is in sliding contact with projection 310*b* and structure 315*b* is in sliding contact with projection 310*a*. When members 310*a*, 310*b* mate with each other, slits 320*a*, 320*b* at least partially align with each other to define a single slit 520 (of FIG. 5).

Figure 4:
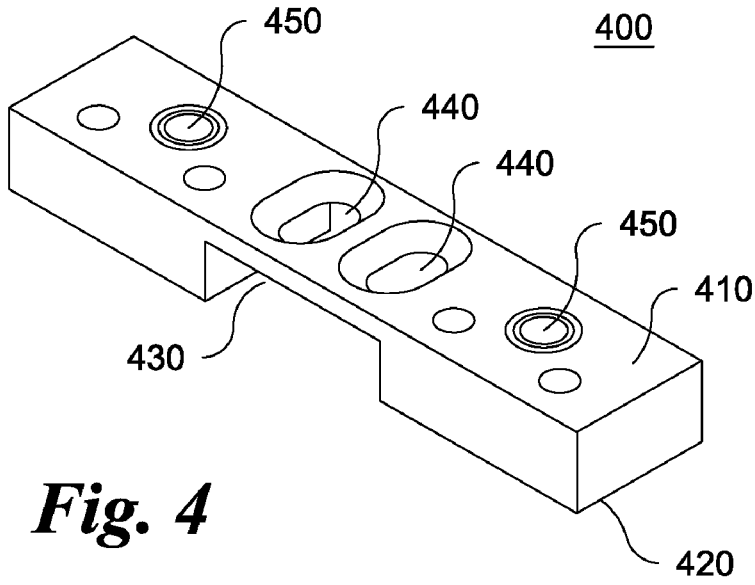
FIG. 4 is an isometric view of a side member as per an embodiment of the invention.

Referring now to FIG. 4, a side member 400 according to an embodiment of the invention is illustrated. Side member 400 has an upper surface 410 and a lower surface 420. An indentation 430 is formed in the lower surface 420. Indentation 430 is generally dimensioned to mate with wing member 330*a* or 330*b*. Side member 400 has through apertures 440 defined therein, which apertures 440 open in indentation 430. Apertures 440 are adapted to mate with apertures 340, but are wider than apertures 340. In an exemplary embodiment, apertures 440 are generally oval along the width of side member 400, whereas apertures 340 are generally circular. In an exemplary embodiment, apertures 440 have beveled edges. In the illustrated embodiment, side member 400 has two (2) apertures 440. In other embodiments, apertures 440 may be more or less than two (2) in number, generally but not necessarily being the same in number as apertures 340 in each of wing members 330*a*, 330*b*. Side member 400 also has other through apertures 450 defined therein on either side of apertures 440. Apertures 450 may or may not be of the same size and are adapted to receive various fasteners such as screws and bolts. Apertures 450 may or may not have internal threads (not shown) for engaging with fasteners (not shown). In the illustrated embodiment, apertures 450 are in clusters of three (3), generally in a triangular pattern. In other embodiments, apertures 450 may have different pattern and be more or less than three (3) in number. In an exemplary embodiment, side member 400 has a length generally equal to that of members 310*a*, 310*b*. In another embodiment, side member 400 may have a length shorter or longer than that of members 310*a*, 310*b*.

Figure 5:
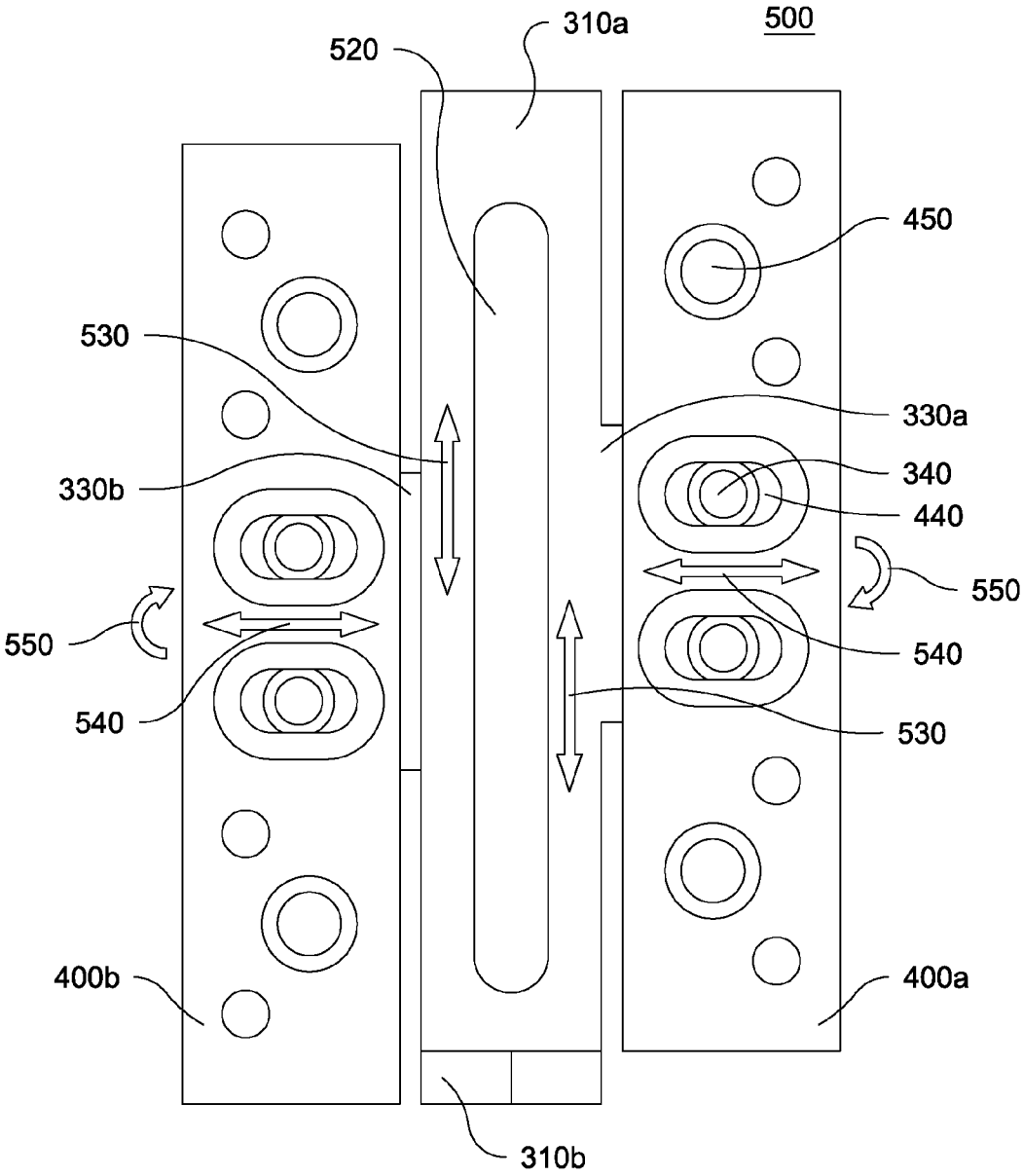
FIG. 5 is a front view of an assembled adjustable hinge block as per an embodiment of the invention.
Figure 6:
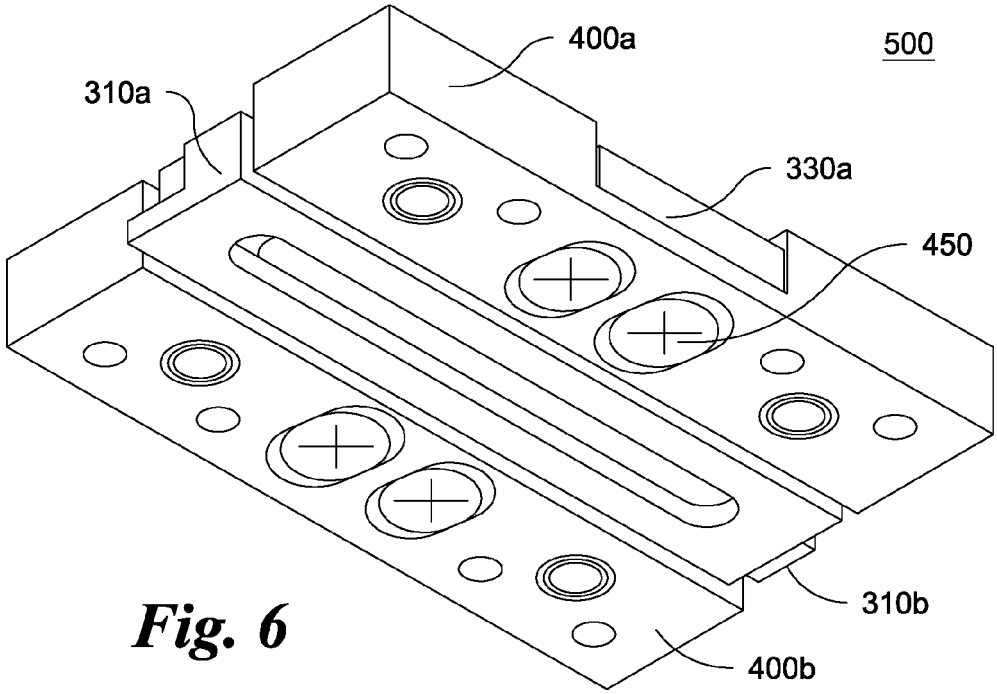
FIG. 6 is an isometric view of the assembled adjustable hinge block of FIG. 5.

Referring now to FIG. 5, an assembled hinge block 500 according to an embodiment of the invention is illustrated. Complementary members 310*a*, 310*b* mate with each other to form a single slit 520. In the illustrated embodiment, member 310*a* is illustrated slightly offset in longitudinal direction with respect to member 310*b* to illustrate the concept of adjustment in a longitudinal direction available in the exemplary adjustable hinge block 500 of the present invention. Arrows 530 illustrate a direction in which a certain flexibility or degree of adjustment is available for arranging members 310*a*, 310*b* relative to each other. Two side members 400*a*, 400*b* are positioned in each side of slit 520, such that apertures 440 generally align with apertures 340 of wing members 330*a*, 330*b* respectively. Indentations 430 (of FIG. 4) of side members 400*a*, 400*b* align and mate with wing members 330*a*, 330*b* respectively. Apertures 440 are generally wider than apertures 340 generally in a direction transverse to longitudinal slit 520. Because of extra width of apertures 340, a certain flexibility or degree of adjustment is available in the direction shown by arrows 540. Slight angular adjustment may also be made as shown by arrows 550 because apertures 440 are slightly bigger than apertures 340. FIG. 6 illustrates an isometric view of the assembled adjustable hinge block of FIG. 5.

Figure 7A:
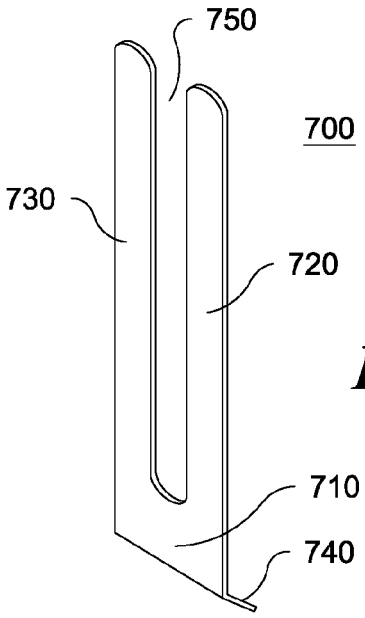
FIG. 7A is an isometric view of an embodiment of a drop behind shim.
Figure 7B:
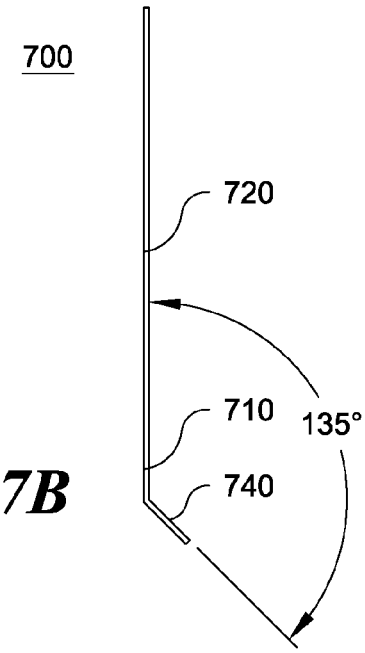
FIG. 7B is a side view of the drop behind shim of FIG. 7A.

Referring now to FIGS. 7A-7B, a drop behind shim 700 as per an embodiment of the invention is illustrated. Shim 700 has a generally thin planar metal base 710. Two planar prongs 720, 730 extend from base 710 and define a gap 750. An angular projection 740 projects from base 740, angling away from the plane of base 710 and prongs 720, 730.

Figure 8:
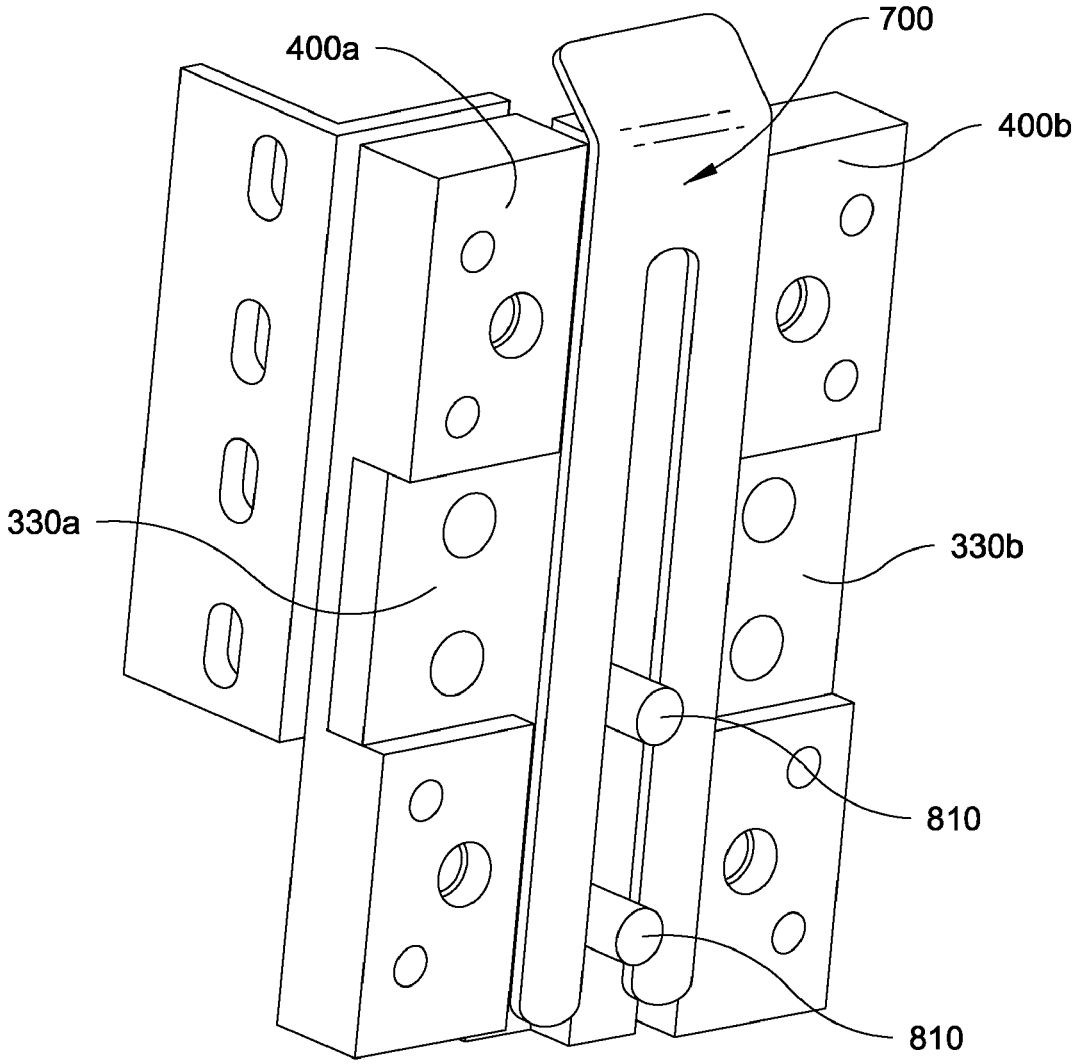
FIG. 8 is a back view of the assembled adjustable hinge block of FIG. 5 with the drop behind shim of FIG. 7A.

Referring now to FIG. 8, a method of using drop behind shim 700 is illustrated. Shim 700 may be used for leveling hinge block 500 mounted on a structural post (not shown). Occasionally, the need to level block 500 may be realized after fasteners 810 have been installed to mount block 500 to a structural post. Shim 700 with two prongs 710, 720 (of FIG. 7) facilitates such leveling without having to remove fasteners 810. Shim 700 may be inserted in a slight gap between block 500 and a structural post (not shown) such that prongs 710, 720 each slide on each side of fasteners 810.

Figure 9:
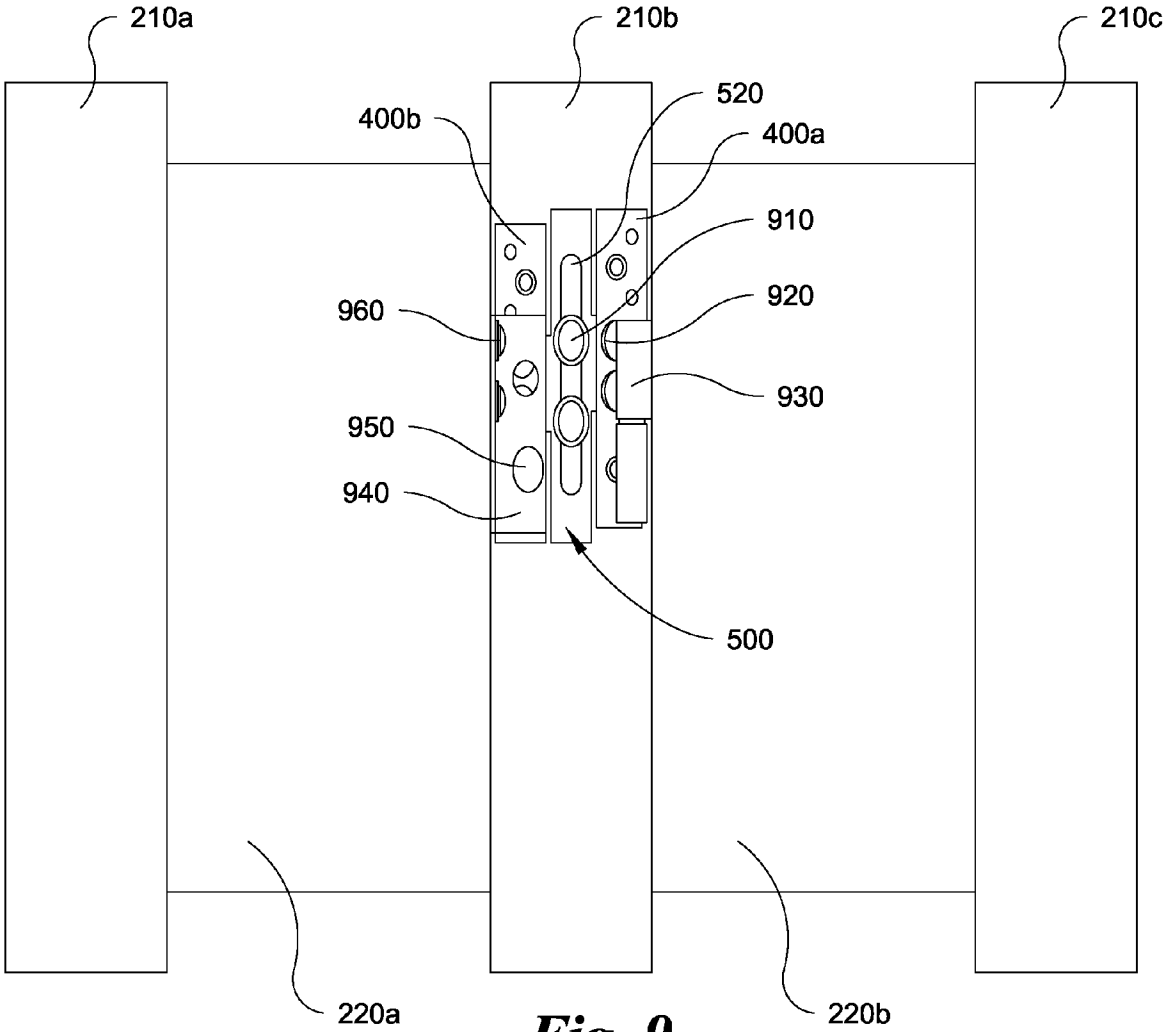
FIG. 9 illustrates the installing of two doors to a single structural post using an adjustable hinge block as per an embodiment of the invention.

Referring now to FIG. 9, a method of installing two doors 220*a*, 220*b* to a single structural post 210*b* using an exemplary embodiment of adjustable hinge block 500 is illustrated. The term "door" includes, by way of example only and not limited to, any structural element that is movable barrier for opening and closing an entranceway, cupboard, cabinet, or the like, commonly turning on hinges. Complementary members 310*a*, 310*b* are mated with each other and combinedly mounted to structural post 210*b* using fasteners 910. Fasteners 910 pass through longitudinal slit 520. Members 310*a*, 310*b* may be adjusted slightly in a longitudinal direction based on the height requirement of doors 220*a*, 220*b*. Side members 400*a*, 400*b* are mounted to wing members 330*a*, 330*b* (of FIG. 5), respectively, using fasteners 920.

A hinge pin 930 is used to mount door 220*b* to structural post 210*b* via hinge block 500. Hinge pin 930 is mounted to side member 400*a* using fasteners (not shown). Hinge pin 930 allows door 220*b* to open and close. Door 220*a*, on other hand, is locked to structural post 210*b* using an L-bracket 940. L-bracket 940 is mounted to block 500 using fasteners 950. Fastener 950 may, by way of example only, a thumbscrew. L-bracket 940 is installed on door 220*a* using fasteners 960.

If there is a slight misalignment resulting from mounting (not shown) of door 220*a* to post 210*a*, adjustable hinge block 500 may be adjusted to mount door 220*a* to post 210*a*, without propagating the misalignment to the mounting of door 220*b* to post 210*b*. If there is no misalignment between posts 210*a*, 210*b*, 210*c* and doors 220*a*, 220*b*, side members 400*a*, 400*b* will be symmetrical with respect to complementary members 310*a*, 310*b*. If there is some misalignment, side members 400*a*, 400*b* will be asymmetrically connected with respect to complementary members 310*a*, 310*b* and thus compensate for the misalignment.

Although the present invention has been set forth in terms of the exemplary embodiments described herein, it is to be understood that such disclosure is purely illustrative and is not to be interpreted as limiting. Consequently, without departing from the spirit and scope of the invention, various alterations, modifications, and/or alternative applications of the invention will, no doubt, be suggested to those skilled in the art after having read the preceding disclosure. Accordingly, it is intended that the present invention be interpreted as encompassing all alterations, modifications, or alternative applications as fall within the true spirit and scope of the invention.

What is claimed is:

1. An adjustable hinge block comprising:

first and second members, said first and second members each defining therein a first and a second slit respectively, said first and second members adapted to mate with each other such that said first and second slits at least partially align with each other to define a third slit;

first and second wing members protruding from said first and second members respectively such that said first and second wing members lie on opposite sides of said third slit when said first and second members mate with each other, said first and second wing members each defining a first and a second aperture respectively; and first and second side members, said first and second side members defining third and fourth apertures, such that each of said third and fourth apertures is adapted to align with said first and second apertures of said first and second wing members respectively.

2. The adjustable hinge block of claim 1, wherein said first and second members are complementary.

3. The adjustable hinge block of claim 1, further comprising a drop behind shim, said shim adapted to be positioned between said an assembly of said first and second members and a surface on which said assembly is mounted.

4. The adjustable hinge block of claim 3, wherein said drop behind shim comprises:

a base; and first and second prongs protruding from said base, said first and second prong defining a gap generally corresponding to said third slit.

5. The adjustable hinge block of claim 4, wherein said drop behind shim further comprises an angular portion angling away from the plane of said shim, said angular portion protruding from said base.

6. The adjustable hinge block of claim 1, wherein said third and fourth apertures in said first and second side members are wider than said first and second apertures in said first and second wing members.

7. The adjustable hinge block of claim 6, wherein said third and fourth apertures in said first and second side members are oval-shaped.

8. The adjustable hinge block of claim 1, wherein said third and fourth apertures in said first and second side members have beveled edges.

9. A method of installing two doors on a structural member, said method comprising the steps of:

mounting an adjustable hinge block on the structural member, wherein said adjustable hinge block comprises:

first and second complementary members, said first and second members each defining therein a first and a second slit respectively, said first and second members adapted to mate with each other such that said first and second slits at least partially align with each other to define a third slit;

first and second wing members protruding from said first and second members respectively such that said first and second wing members lie on opposite sides of said third slit when said first and second members mate with each other, said first and second wing members each defining a first and a second aperture respectively;

connecting said first and second members to the structural member using a fastener, said fastener passing through said third slit;

connecting first and second side members to said first and second wing members using a fastener, wherein said first and second members are adapted to provide symmetrical and asymmetrical connections of said first and second side members with respect to said first and second members; and connecting a door to each of said first and second side members using a fastener.

10. The method of claim 9, wherein said step of connecting a first and a second door to each of said first and second side members comprises a step of using a hinge to connect to said first and second doors to said first and second side members.

11. The method of claim 9, further comprising a step of inserting a shim between said adjustable hinge block and the structural member.

* * * * *